US006692300B2

(12) United States Patent
Kanda et al.

(10) Patent No.: US 6,692,300 B2
(45) Date of Patent: Feb. 17, 2004

(54) COAXIAL CABLE CONNECTOR

(75) Inventors: Takayoshi Kanda, Fukui (JP); Nobuyoshi Matsuda, Fukui (JP)

(73) Assignee: Mitsubishi Cable Industries, Ltd., Hyogo (JP)

( * ) Notice: Subject to any disclaimer, the term of this patent is extended or adjusted under 35 U.S.C. 154(b) by 0 days.

(21) Appl. No.: 10/149,081

(22) PCT Filed: Dec. 18, 2000

(86) PCT No.: PCT/JP00/08963

§ 371 (c)(1),
(2), (4) Date: Jun. 10, 2002

(87) PCT Pub. No.: WO01/45214

PCT Pub. Date: Jun. 21, 2001

(65) Prior Publication Data

US 2002/0193005 A1 Dec. 19, 2002

(30) Foreign Application Priority Data

Dec. 16, 1999 (JP) ..... 11-356937

(51) Int. Cl.[7] ..... H01R 9/05
(52) U.S. Cl. ..... 439/583
(58) Field of Search ..... 439/578, 583

(56) References Cited

U.S. PATENT DOCUMENTS 5,137,470 A * 8/1992 Doles ..... 439/578
5,545,059 A * 8/1996 Nelson ..... 439/583

FOREIGN PATENT DOCUMENTS

| | | |
|---|---|---|
| JP | 5-275144 | * 10/1993 |
| JP | 9-106866 | 4/1997 |
| JP | 09106866 | * 4/1997 |
| JP | 10-172679 | 6/1998 |

* cited by examiner

*Primary Examiner*—Gary Paumen
(74) *Attorney, Agent, or Firm*—Nixon Peabody, LLP

(57) ABSTRACT

Disclosed is a connector 100 which has a center contact 20 electrically connected to an inner conductor formed of a corrugated duct, a tubular body 60 electrically connected to an outer conductor and surrounding the center contact 20, and an insulating member 70 by which the center contact 20 and the tubular body 60 are insulated electrically from each other. The center contact 20 is provided with an external thread part 22 which is brought into mating engagement with the inner conductor, and the external thread part 22 has a first external thread of a first pitch shorter than the pitch of the corrugated duct.

4 Claims, 5 Drawing Sheets

COAXIAL CABLE CONNECTOR

TECHNICAL FIELD

The present invention relates to coaxial cable connectors and, in particularly, to a coaxial cable connector having a helical duct-like inner conductor.

BACKGROUND ART

With the spread of the utilization of mobile communications, there have been more exacting demands for better-quality coaxial cables and coaxial cable connectors for use in antenna feeders of portable telephones, car telephones, and radio call system base stations.

FIG. 5 shows a typical partially cutaway cross-sectional view of a coaxial cable 400 known in the art (for example, WF-H50-13, a WF-H coaxial cable by MITSUBISHI CABLE INDUSTRIES, LTD.). On the other hand, FIG. 6 shows a typical partially cutaway cross-sectional view of a conventional connector 500 (for example, WF-H13D-BFX20D, a WF-H coaxial cable connector by MITSUBISHI CABLE INDUSTRIES, LTD.) for the coaxial cable 400. In these Figures, both the coaxial cable 400 and the connector 500 are shown substantially in their actual sizes.

As seen in FIG. 5, the coaxial cable 400 has an inner conductor 42, an outer conductor 44, an insulating body 46 interposed between the inner conductor 42 and the outer conductor 44, and a coating layer 48 for providing protection of the outer conductor 44. The inner conductor 42 and the outer conductor 44 are each formed by a corrugated duct. Typically, the outer conductor 44 is formed by a ring-like corrugated duct, whereas the inner conductor 42 is formed by a helical corrugated duct (also called the "helical duct"), as shown in FIG. 5. It is to be noted that the term "corrugated duct" which has been used in the specification of the present invention includes both ring-like and helical corrugated ducts.

The inner conductor 42 in the form a helical duct (hereinafter also referred to as the helical duct 42) has a small diameter part 42*a* and a great diameter part 42*b*. An external thread is formed in an outside surface of the helical duct 42 at a fixed pitch and an internal thread is formed in an inside surface of the helical duct 42 at a fixed pitch. The inner conductor 42 and the outer conductor 44 are each formed by for example a copper duct. The insulating body 46 is made of for example low density expanded polyethylene, and the coating layer 48 (also called the "anti-corrosion layer) is made of polyethylene. Connectors of the present invention are capable of serving as a connector for the coaxial cable 400 (FIG. 5) and will be described by making reference also to FIG. 5.

Referring now to FIG. 6, the structure of the connector 500 will be described. For the sake of simplicity, an exemplary case, in which the connector 500 is mounted to the coaxial cable 400 (FIG. 5), will be described below.

The connector 500 of FIG. 6 has a center contact 50 which is electrically connected to the inner conductor 42 of the coaxial cable 400, a tubular body (body) 60 which is electrically connected to the outer conductor 44 of the coaxial cable 400 and which surrounds the center contact 50, an insulating member 70 by which the center contact 50 and the tubular body 60 are insulated electrically from each other.

The center contact 50 is roughly cylindrical and has a cable-side center contact 51 and an opening-side center contact 52. The cable-side center contact 51 and the opening-side center contact 52 are brought into mating engagement with each other in an area 50*a*, whereby they are connected together electrically.

The cable-side center contact 51, which is roughly cylindrical, has an external thread part 51*a*. The external thread part 51*a* is brought into mating engagement with the inside of the helical duct (the inner conductor) 42 of the coaxial cable 400. In other words, the external thread part 51*a* has an external thread formed at the same pitch as that of an internal thread formed in the inside surface of the helical duct 42. Further, in order to ensure that the cable-side center contact 51 and the helical duct 42 are connected together, a top-like member 54 inserted in the inside of the cable-side center contact 51 of roughly cylindrical shape is used to extend an end (a slot part) of the cable-side center contact 51 inserted within the helical duct 42. This makes utilization of a force exerted by tightening of a bolt 55*a* passing through the top-like member 54. More specifically, when the bolt 55*a* is tightened, the top-like member 54 is drawn toward the end of the helical duct 42 (the left-hand end in the Figure), thereby causing a tapered outside surface of the top-like member 54 to radially push and extend a tapered inside surface of the cable-side center contact 51. The degree of such extension can be controlled by adjusting the amount of tightening of the bolt 55*a*. When the bolt 55*a* is loosened, i.e., when the bolt 55*a* is turned left, the top 54 travels to the right (in the direction in which the top 54 comes off) while being in abutment with a stopper 53. If the bolt 55*a* is further rotated, this finally causes the top 54 to come off the bolt 55*a*. To prevent this, there is provided a nut 55*b*.

The cable-side end of the opening-side center contact 52 has an outside surface in abutment with the inside surface of the cable-side center contact 51 and an end surface in abutment with the stopper 53. The outside surface of the opening-side center contact 52 in abutment with the inside surface of the cable-side center contact 51 has an external thread which is brought into mating engagement with an internal thread formed in the inside surface of the opening-side center contact 52. This mating area is the area 50*a* (FIG. 6). Defined in an opening-side end of the opening-side center contact 52 is a hollow part (hole) 52*a*. A center contact (a cylindrical projecting part) of another connector (not shown) is received in the hollow part 52*a*, whereby the inner conductors of the two coaxial cables to be connected together are connected together electrically. Further, a hole 52*b* is defined diametrally, passing through the center of the cylindrical opening-side center contact 52. The hole 52*b* can be used as an insertion hole through which a rod-like jig for rotating the opening-side center contact 52 is inserted, when the opening-side center contact 52 is threaded into the cable-side center contact 51.

The tubular body 60 has a first connecting tube 61 which is connected to the other connector (not shown) and a second connecting tube 62 which is, at its cable-side end, internally interfitted into the first connecting tube 61. A split clamp 63 is disposed within the second connecting tube 62. The split clamp 63, having an internal diameter and an internal surface shape conforming to an outer peripheral shape of the outer conductor 44 of the coaxial cable 400, is externally interfitted in the vicinity of a connecting end of the outer conductor 44. Further, an O ring 64 is disposed in the inside of the second connecting tube 62 so that the O ring 64 is brought into close contact with the coating layer 48 of the coaxial cable 400. The second connecting tube 62 is fixed, through the split clamp 63 and the O ring 64, to the coaxial cable 400 by application of pressure.

The first connecting tube 61 is externally interfitted to an end of the second connecting tube 62, and the first connecting tube 61 and the second connecting tube 62 are fixedly connected together at flanges 61*a* and 62*a* mounted on the first and second connecting tubes 61 and 62, respectively, by using for example a bolt. The end of the outer conductor 44 is located so as to be compressed and supported between the split clamp 63 and the first connecting tube 61 by virtue of force by which the first connecting tube 61 and the second connecting tube 62 are fixedly connected together, thereby further ensuring that the outer conductor 44 and the tubular body 60 (which is made up of the first connecting tube 61 and the second connecting tube 62) are brought into electrical connection with each other through the split clamp 63.

Further, the first connecting tube 61 has an inside surface in abutment with the outside surface of the annular insulating member 70 disposed around the center contact 50, and the relative position between the first connecting tube 61 and the center contact 50 is fixed through the insulating member 70. The first connecting tube 61 has, at the end opposite to the flange 61*a*, a flange 61*b* and is fixedly connected to the other connector (not shown) through the flange 61*b* by using for example a bolt (not shown), whereby the outer conductors of the two coaxial cables to be connected together are brought into electrical connection with each other.

However, the conventional connector 500 has the following problems. The center contact 50 of the connector 500 has a relatively complicated structure because of the cable-side center contact 51 and the opening-side center contact 52, thereby increasing production costs. Further, the step of mounting the center contact 50 is complicated, and in the step of extending the end (slot part) of the cable-side center contact 51 inserted within the helical duct 42, it is required that the degree of extension (the amount of tightening of the bolt 55*a*) be controlled adequately in order not to cause damage to the inner conductor. Furthermore, in some cases the opening-side center contact 52 and the cable-side center contact 51 undergo seizing to become unseparatable.

DISCLOSURE OF THE INVENTION

The present invention was made with a view to providing solutions to the above-described problems with the prior art techniques. Accordingly, an object of the present invention is to provide simple-structure, inexpensive, easy-to-mount coaxial cable connectors.

The present invention provides a connector which is mounted to an end of a coaxial cable having an outer conductor and an inner conductor formed of a corrugated duct insulated from the outer conductor. The connector of the present invention comprises: a center contact electrically connected to the inner conductor; a tubular body electrically connected to the outer conductor and surrounding the center contact; and an insulating member by which the center contact and the tubular body are insulated electrically from each other, wherein the center contact has an external thread part which is brought into mating engagement with the inner conductor, and wherein the external thread part has a first external thread of a first pitch shorter than a pitch of the corrugated duct.

The first external thread of the center contact may be brought into mating engagement with an inside surface of a small diameter part of the corrugated duct at the first pitch.

An arrangement may be made in which the corrugated duct of the inner conductor is a helical duct; the external thread part of the center contact further has a second external thread of a second pitch identical with a helical pitch of the helical duct; and the first external thread is formed in a great diameter part of the second external thread, and the second external thread is brought into mating engagement with the helical duct at the second pitch and the first external thread is brought into mating engagement with an inside surface of a great diameter part of the helical duct at the first pitch.

Preferably, the first external thread is brought into mating engagement with an inside surface of the inner conductor by self tapping.

Hereinafter, the operation of the present invention will be describe.

The connector of the present invention is provided with a center contact having an external thread the pitch of which is shorter than that of the corrugated duct constituting an inner conductor, and the external thread of the center contact is brought into mating engagement with the inner conductor. As the corrugated duct, either an annular corrugated duct or a helical corrugated duct may be used.

To those skilled in the art, forming threads in the inside surface of a duct whose inside diameter is not constant has been an inconceivable technical practice. This was examined by the inventor(s), and the results show that it is possible to provide sufficiently stable center contact/corrugated duct joining by threading a center contact having a first external thread of a first pitch into a corrugated duct having a pitch greater than the first pitch. Further, if a center contact is formed using a material harder than that of a corrugated duct, this not only eliminates the need for preformation of an internal thread in the inside surface of a corrugated duct but also makes it possible to form an internal thread in a corrugated duct by a self tapping technique using an external thread formed in the center contact. Accordingly, unlike the above-mentioned conventional technique, there is no need to carry out the step of extending a center contact end, and it is possible to form a center contact in the form of a single piece.

In the case inner conductors are formed of a helical duct, an external thread (a second external thread) of the same pitch as the helical pitch of the helical duct (i.e., a second pitch) is formed in a center contact and a first external thread of a first pitch (short pitch) is formed in a maximum diameter part of the second external thread. As a result of such arrangement, it is possible to bring the center contact and the helical duct into mating engagement with each other by both the first and second external threads. This provides more stable joining. Also in this structure, a corresponding internal thread to the first external thread can be formed in the inside surface of the helical duct by self tapping.

BEST MODE FOR CARRYING OUT THE INVENTION

Coaxial cable connectors as embodiments of the present invention will be described in conjunction with the Figures.

Figure 1:
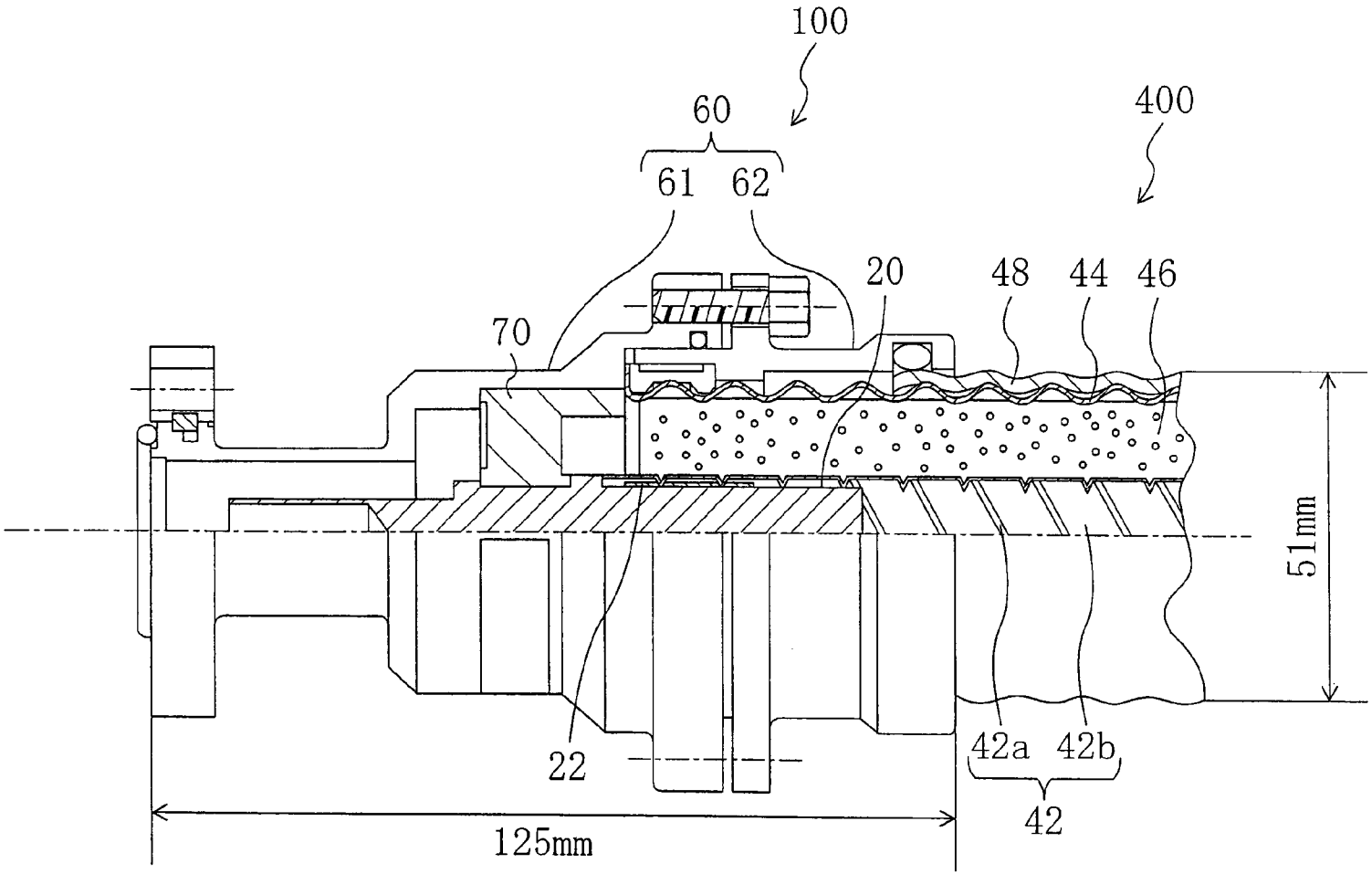
FIG. 1 is a typical partially cutaway cross-sectional view of a connector 100 as an embodiment of the present invention.
Figure 5:
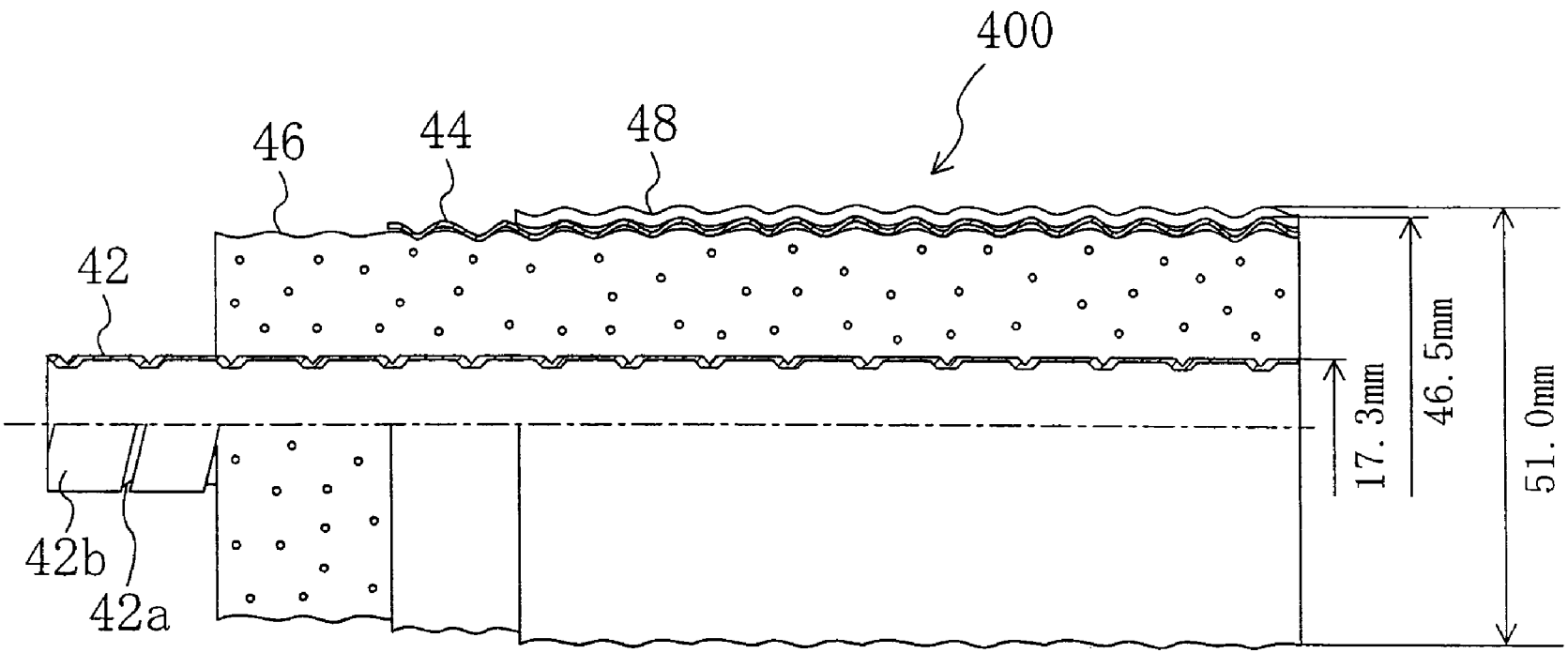
FIG. 5 is a typical partially cutaway cross-sectional view of a coaxial cable 400 known in the art.

FIG. 1 is a typical partially cutaway cross sectional view of a connector 100 as an embodiment of the present invention. The connector 100 serves as a connector for for example the coaxial cable 400 shown in FIG. 5. For the purpose of providing an easy understanding, FIG. 1 shows the connector 100, with the coaxial cable 400 mounted thereto. FIG. 1 shows the connector 100 and the coaxial cable 400 substantially in their actual sizes.

Figure 6:
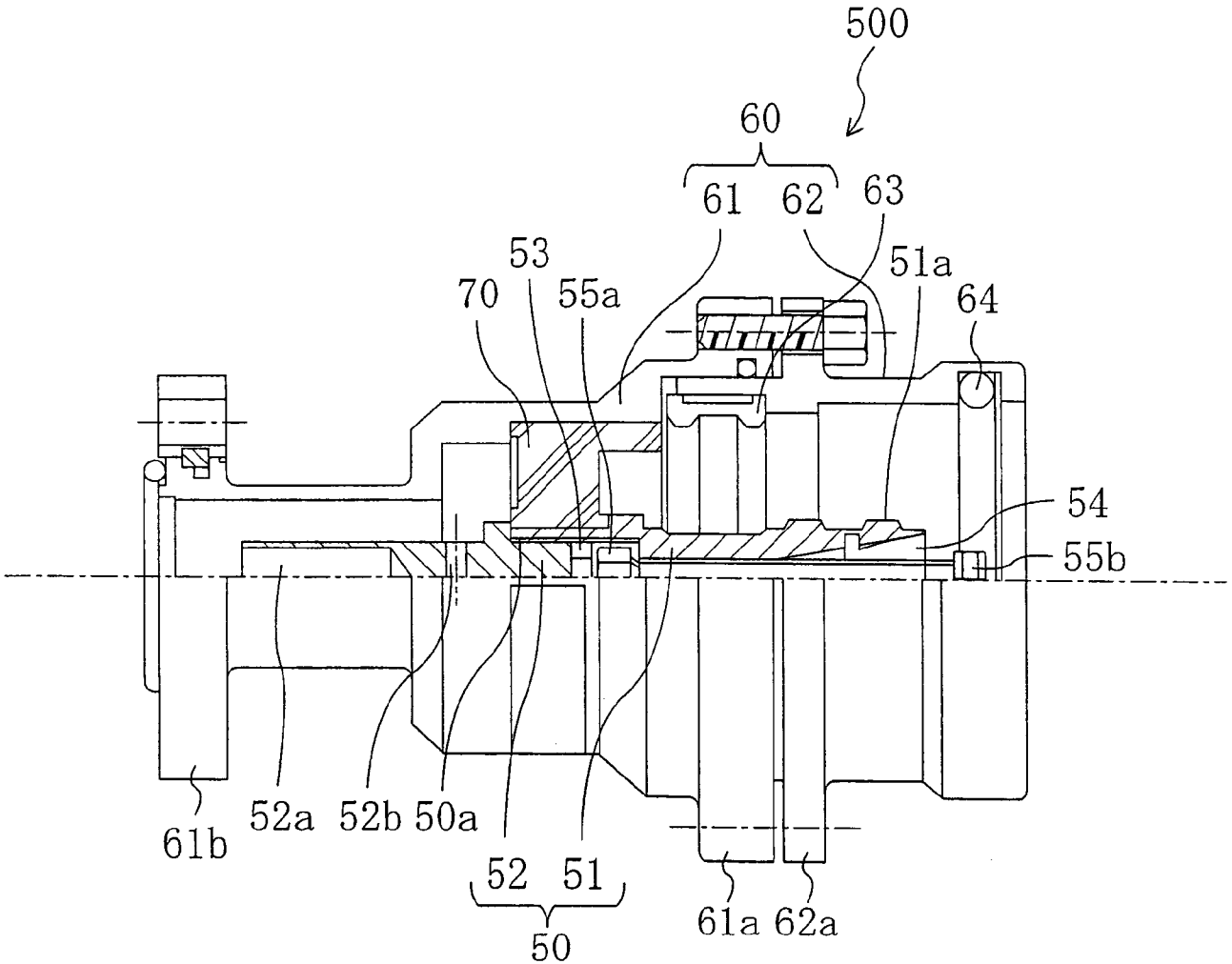
FIG. 6 is a typical partially cutaway cross-sectional view of a conventional connector 500 for the coaxial cable 400.

The connector 100 is characterized by the structure of a center contact 20, and the other structures may be the same as the connector 500 (FIG. 6), as shown in FIG. 1. For the sake of simplicity, functionally equivalent components of the connector 100 to the connector 500 have been assigned the same reference numerals and they are not described here.

The connector 100 has: a center contact 20 which is electrically connected to the inner conductor (helical duct) 42 of the coaxial cable 400; a tubular body (body) 60 which is electrically connected to the outer conductor 44 of the coaxial cable 400 and which surrounds the center contact 20; and an insulating member 70 by which the center contact 20 and the tubular body 60 are insulated electrically from each other. Unlike the center contact 50, the center contact 20 is formed in the form of a single piece and is brought into mating engagement with an inside surface of the helical duct 42 by an external thread formed in an external thread part 22 inserted within the helical duct 42. The pitch of the external thread formed in the external thread part 22 (note that the external thread is also indicated by reference numeral 22) is shorter than that of the corrugated duct 42. In the Figure, as a corrugated duct constituting the inner conductor 42 is in the form of a helical duct; however, the present invention can be applied also to an annular corrugated duct.

Figure 2:
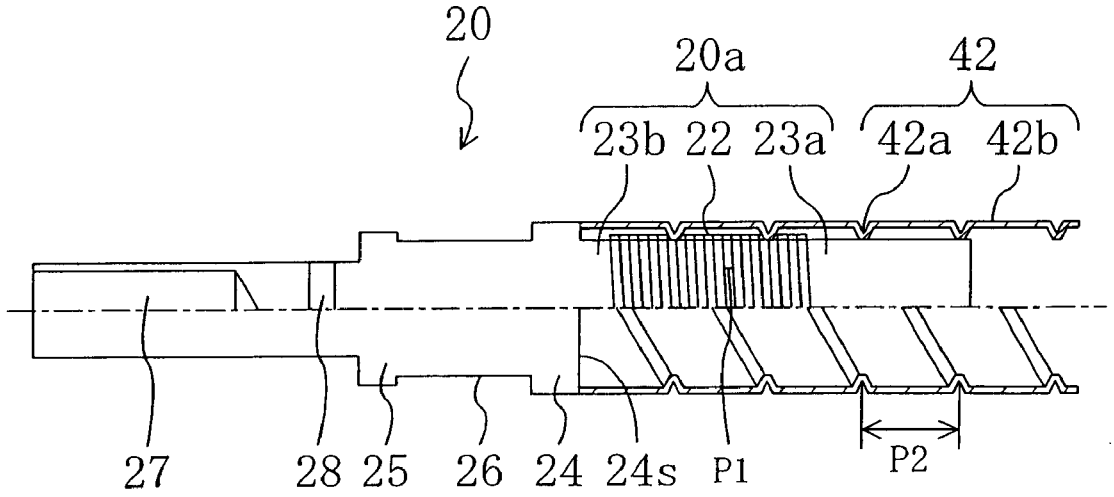
FIG. 2 is a partially cutaway cross-sectional view typically illustrating a mounting state in which a center contact 20 for use in the connector 100 is mounted to a helical duct 42.

Referring now to FIG. 2, the structure of the center contact 20 will be described in greater detail. FIG. 2 is a partially cutaway cross-sectional view (enlarged view) typically illustrating the center contact 20 mounted to the helical duct 42.

The center contact 20 is substantially cylindrical and has an anchor part 20*a* which is inserted within the helical duct 42, two projecting parts 24 and 25 (sections where the cylinder becomes greater in diameter), and a hollow part (hole) 27 for receiving therein another connector to be connected. The projecting part 24 on the side of the anchor part 20*a* has an outer end surface 24*s* which is perpendicular to the axial center line (indicated by a long dashed short dashed line of the Figure), and the center contact 20 is mounted to the helical duct 42 so that an end surface of the helical duct 42 is brought into abutment with the end surface 24*s*. The insulating member 70 (see FIG. 1) is externally interfitted onto a concave circumferential surface 26 defined between the two projecting parts 24 and 25. Axial movement of the insulating member 70 provided in annular fashion is controlled and prevented by the projecting parts 24 and 25. As shown in FIG. 1, the outside surface of the insulating member 70 is brought into abutment with the inside surface of the first connecting tube 61 and functions so as to fix the relative position between the first connecting tube 61 and the center contact 20.

The anchor part 20*a* of the center contact 20 has an external thread part 22. The external thread part 22 has an external thread at a pitch p1 shorter than that of the helical duct 42 (i.e., a pitch p2) and is brought into mating engagement with an inside surface of the small diameter part 42*a* of the helical duct 42. The internal thread formed in the inside surface of the small diameter part 42*a* of the helical duct 42 comprises intermittent grooves formed so as to correspond to thread ridges of the external thread 22. In an example shown in the Figure, the pitch p2 of the helical duct 42 is about 10 mm, whereas the pitch p1 of the external thread of the external thread part 22 is about 1 mm (thread overlap: about 0.5 mm). Formed in the inside surface of the small diameter part 42*a* are about nine intermittent grooves per round.

Preferably, the external thread pitch p1 falls within the range of ⅔ to ¼ of the width of the small diameter part 42*a*. If the pitch p1 of the external thread 22 is too great with respect to the width of the small diameter part 42*a*, the number of internal thread grooves (per unit length) formed in the inside surface of the small diameter part 42*a* becomes too small, producing the undesirable requirement that the length of the external thread part 22 which is brought into mating engagement with the inside surface of the small diameter part 42*a* be made longer in order that the center contact may be mounted more stably within the helical duct 42. Further, if the pitch p1 of the external thread 22 is too small, this produces the undesirable problem of making thread formation difficult to carry out. The external thread 22 may be a single-start thread or a multi-start thread. Further, the length of the external thread part 20*a* is for example about twice the pitch p2 of the helical duct 42. The pitch p1 of the external thread 22 and the length of the external thread part (mating engagement part) 20*a* may be determined appropriately to the strength required.

Usually, the helical duct 42 is made of copper, and if the center contact 20 is formed using a material harder than copper, this makes it possible, in a step of threading the anchor part 20*a* into the helical duct 42, to form, in a self tapping manner using the external thread formed in the external thread part 22, an internal thread in the inside surface of the small diameter part 42*a* of the helical duct 42. That is, in the step of mounting the connector 100 at the job site, it is possible to perform mounting of the connector 100 while forming an internal thread in the inside surface of the helical duct 42.

The anchor part 20*a* of the center contact 20 has, at the cable side of the external thread part 22, a guide part 23*a* the outer diameter of which is smaller than the inner diameter of the small diameter part 42*a* of the helical duct 42. The guide part 23*a* is provided to facilitate insertion of the anchor part 20*a* within the helical duct 42. In order that the anchor part 20*a* may be located symmetrically about the center of the helical duct 42, preferably the outer diameter of the guide part 23*a* is set so that there is defined a slight clearance between the outside surface of the guide part 23*a* and the inside surface of the small diameter part 42*a* of the helical duct 42. If the outer diameter of the cylinder-like guide part 23*a* is too small with respect to the inner diameter of the small diameter part 42*a* of the helical duct 42, this may cause the anchor part 20*a* to deviate from the center of the helical duct 42 thereby to result in causing interference with thread formation by self tapping and thread mating. Further, the guide part 23*a* may be tapered to provide a structure capable of facilitate introduction of the anchor part 20*a* into the helical duct 42.

The anchor part 20*a* of the center contact 20 has, at the side of the projecting part 24 of the external thread part 22, an end part 23*b*. The outer diameter of the end part 23*b* is smaller than the inner diameter of the small diameter part 42*a* of the helical duct 42. The end part 23*b* is a non-threaded part.

Further, the hole 28, defined diametrally so as to pass through the center of the cylinder-like center contact 20, can be used as an insertion hole through which a rod-like jig for rotating the opening-side center contact 52 is inserted, when the anchor part 20*a* is threaded within the helical duct 42 and/or when the inside surface of the helical duct 42 is self tapped. The hole 28 may not necessarily be provided.

As described above, the center contact 20 has an external thread (i.e., the external thread part 22) of the pitch p1 shorter than the pitch p2 of the helical duct 42 and the external thread 22 of the center contact 20 is brought into mating engagement with the inside surface of the small diameter part 42*a* of the helical duct 42 at the pitch p1. Against common technical practice, it was confirmed that the center contact was joined to the helical duct 42 by the aforementioned structure although only intermittent grooves were formed in the inside surface of the helical duct 42 whose inner diameter is not constant. Therefore, neither a center contact having a complicated structure nor a complicated mounting step is required, unlike the conventional connector 500.

Although the helical duct 42 as a corrugated duct has been described as an embodiment of the present invention, the present invention is applicable to an annular corrugated duct.

Figure 3:
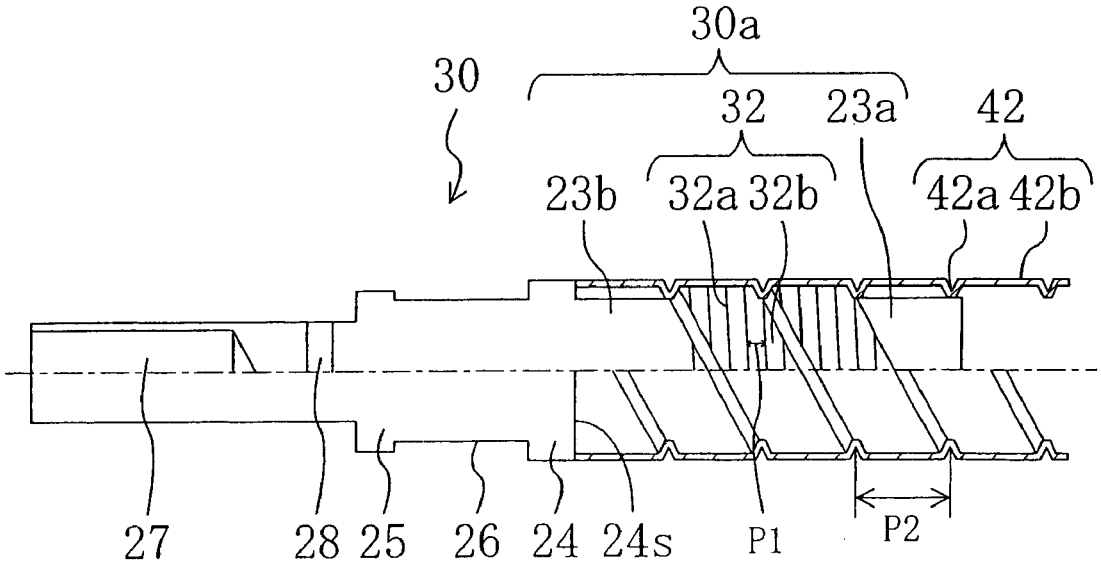
FIG. 3 is a partially cutaway cross-sectional view typically illustrating a state in which another center contact 30 for use in the connector 100 is mounted to the helical duct 42.

Referring next to FIG. 3, another center contact 30 for use in the connector 100 of the present embodiment will be described. FIG. 3 is a partially cutaway cross-sectional view (enlarged view) typically showing the center contact 30 mounted to the helical duct 42. In the case the helical duct 42 is used as a corrugated duct, the use of the center contact 30 makes it possible to enhance the strength of joining between the center contact 30 and the helical duct 42 to a further extent.

An anchor part 30*a* of the center contact 30 differs from its counterpart of the center contact 20 shown in FIG. 2. Components other than the anchor part 30*a* have been assigned the same reference numerals as FIG. 2 and will not be described here.

The anchor part 30*a* of the center contact 30 has an external thread portion 32. Formed in the external thread portion 32 are a first external thread 32*a* whose pitch p1 is shorter than the pitch p2 of the helical duct 42 and a second external thread 32*b* whose pitch is the same as that of the helical duct 42, i.e., the pitch p2. The first external thread 32*a* is formed in a major diameter part (thread ridge) of the second external thread 32*b*. The second external thread 32*b* is brought into mating engagement with the helical duct 42 at the pitch p2, whereas the first external thread 32*a* is brought into mating engagement with the inside surface of the great diameter part 42*b* of the helical duct 42 at the pitch p1. That is, the second external thread 32*b* is brought into mating engagement with an internal thread of the pitch p2 formed in the inside surface of the helical duct 42 by the small diameter part 42*a* and the great diameter part 42*b*.

On the other hand, the first external thread 32*a* is brought into mating engagement with an internal thread self-tapped in the inside surface of the great diameter part 42*b* of the helical duct 42 by for example the first external thread 32*a*. The internal thread formed in the inside surface of the great diameter part 42*b* of the helical duct 42 is made up of intermittent grooves formed so as to correspond to thread ridges of the external thread 32*a*. For example, the pitch p2 of the helical duct 42 is about 10 mm, whereas the pitch p1 of the external thread 32*a* is about 2 mm (thread overlap: about 1 mm). Formed in the inside surface of the great diameter part 42*b* are about four intermittent grooves per round. Preferably the pitch p1 of the external thread 32*a* falls within the range from 1/5 to 1/10 of the width of the great diameter part 42*b*. Further, from the viewpoint of joint stability, the external thread 32*a* is preferably formed for about two pitches of the helical duct 42.

The external thread 32*a* may be either a single-start thread or a multi-start thread. The pitch p1 of the external thread 32*a* and the length of the external thread part (mating engagement part) 32 may be determined appropriately to the strength required. The external thread 32*a* is not necessarily formed on all the thread ridges of the external thread 32*b*; however, it is preferred that the external thread 32*a* be formed on all the thread ridges of the external thread 32*b* with the view to attaining a sufficient joint strength. Further, the guide part 23*a* may have the same structure and function as its counterpart in the center contact 20 of FIG. 2, and the end part 23*b* may have the same structure and function as its counterpart in the center contact 20 of FIG. 2.

The center contact shown in FIG. 3 has, as described above, the first external thread 32*a* of the pitch p1 shorter than the pitch p2 of the helical duct 42 and the second external thread 32*b* of the same pitch as that of the helical duct 42 (i.e., the pitch p2) and is brought into mating engagement with the helical duct 42 by these threads. It was confirmed that more stable joining was achieved in comparison with the center contact 20 (FIG. 2) matingly engaging the inside surface of the small diameter part 42*a* of the helical duct 42 by the short pitch external thread 22. Unlike the conventional connector 500, neither a complicated structure nor a complicated mounting step is needed. Having a simpler structure, the center contact 20 is inexpensive in comparison with the center contact 30. Adequate selection between these center contacts 20 and 30 may be made depending on application.

Figure 4:
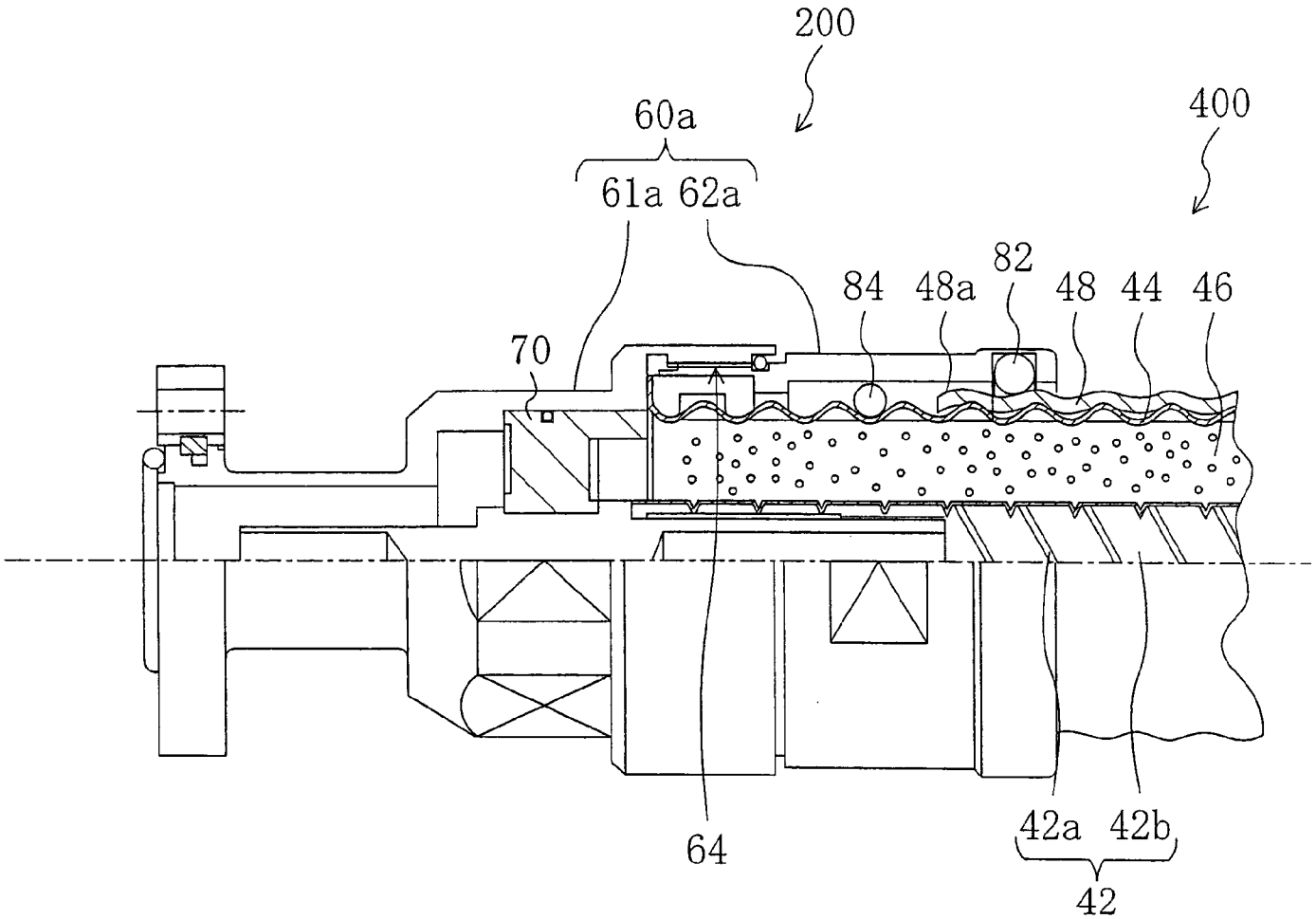
FIG. 4 is a typical partially cutaway cross-sectional view of a connector 200 as another embodiment of the present invention.

FIG. 4 is a typical partially cutaway cross-sectional view of a connector 200 as another embodiment of the present invention. Of the components of the connector 200, components having substantially the same functions as their counterparts in the connector 100 shown in FIG. 1 have been assigned the same referential numerals and they are not described here.

The connector 200 has a center contact 20 identical with the center contact 20 of the connector 100 and a tubular body 60*a*. The tubular body 60*a* differs from the conventional tubular body 60 in that it has such a structure that the first connecting tube 61*a* and the second connecting tube 62*a* matingly engage with each other in the mating engagement part 64.

For example, the first connecting tube 61*a* of the tubular body 60*a* which is connected to another connector (not shown) has an internal thread in the mating engagement part 64, whereas the second connecting tube 62*a* which is internally interfitted in the first connecting tube 61*a* at its cable side end has an external thread in the mating engagement part 64. The first connecting tube 61*a* and the second connecting tube 62*a* are located relative to each other and fixedly connected together by such thread structures, thereby making it possible to carry out attachment work of the connector 200 in an easier way in comparison with conventional connectors.

Further, during attachment of the connector 200, preferably an O ring 84 is provided in a recessed portion of the outer conductor 44 of a corrugated duct exposed in the inside of the second connecting tube 62*a*. The O ring 84 is in contact with the outside surface of the outer conductor 44 and with the inside surface of the second connecting tube 62*a*. Even when there occurs entrance of water to a clearance between the outer conductor 44 and the coating layer 48 due to breakage of the coating layer 48, the O ring 64 prevents the water from moving forward. This therefore improves the reliability of connection established by the connector 200 against water.

Furthermore, it is preferred that an end part 48*a* of the coating layer 48 be cut so that it is located nearer to the leading end than the O ring 82 mounted in the inside of the second connecting tube 62*a*. Such arrangement makes it possible to bring the coating layer 48 and the O ring 82 into more stable contact with each other.

It is, of course, preferred that the connector 100 shown in FIG. 1 be provided with the O ring 84, like the connector 200. Preferably, the position at which the coating layer 48 is cut is shifted toward the leading end.

INDUSTRIAL APPLICABILITY

The present invention provides a coaxial cable connector center contact having an external thread whose pitch is shorter than the pitch of a corrugated duct constituting an inner conductor. The center contact is brought into mating engagement with the inner conductor by the external thread. The center contact is relatively simple in structure and is capable of being jointed to the corrugated duct in sufficiently stable manner. Further, if the center contact is made of a material harder than that of the corrugated duct, this makes it possible to form an internal thread by self tapping without having to preform an internal thread in the inside surface of the corrugated duct, and to bring the center contact and the corrugated duct into mating engagement with each other.

In the case inner conductors are formed of a helical duct, an external thread (a second external thread) of the same pitch as the helical pitch of the helical duct (i.e., a second pitch) is formed in a center contact and a first external thread of a first pitch (short pitch) is formed in a great diameter part of the second external thread. As a result of such arrangement, it is possible to bring the center contact and the helical duct into mating engagement with each other by both the first and second external threads. This provides more stable joining.

Accordingly, the present invention provides coaxial cable connectors capable of providing advantages such as a relatively simple structure, inexpensive production cost, easy mounting.

What is claimed is:

1. A connector which is mounted to an end of a coaxial cable having an outer conductor and an inner conductor formed of a corrugated duct insulated from said outer conductor, said connector comprising:

a center contact formed of a single piece and electrically connected to said inner conductor, a tubular body electrically connected to said outer conductor and surrounding said center contact, and an insulating member by which said center contact and said tubular body are insulated electrically from each other, wherein said center contact has an external thread part which is brought into mating engagement with said inner conductor, and wherein said external thread part has a first external thread of a first pitch shorter than a pitch of said corrugated duct.

2. The connector of claim 1, wherein said first external thread of said center contact is brought into mating engagement with an inside surface of a small diameter part of said corrugated duct at said first pitch.

3. The connector of claim 1, wherein said corrugated duct of said inner conductor is a helical duct; said external thread part of said center contact further has a second external thread of a second pitch identical with a helical pitch of said helical duct; and said first external thread is formed in a great diameter part of said second external thread, wherein said second external thread is brought into mating engagement with said helical duct at said second pitch and said first external thread is brought into mating engagement with an inside surface of a great diameter part of said helical duct at said first pitch.

4. The connector of any one of claims 1–3, wherein said first external thread is brought into mating engagement with an inside surface of said inner conductor by self tapping.

* * * * *